US006364708B1

(12) United States Patent
Chen et al.

(10) Patent No.: US 6,364,708 B1
(45) Date of Patent: Apr. 2, 2002

(54) ELECTRICAL CONNECTOR WITH IMPROVED SUPPORTING DEVICES

(75) Inventors: Qiang Chen; GuangXing Shi, both of Kunsan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/808,205

(22) Filed: Mar. 13, 2001

(30) Foreign Application Priority Data

Dec. 21, 2000 (TW) ..... 89222267 U

(51) Int. Cl.[7] ..... H01R 13/648
(52) U.S. Cl. ..... 439/607
(58) Field of Search ..... 439/607, 567, 439/801, 79

(56) References Cited

U.S. PATENT DOCUMENTS 6,095,865 A * 8/2000 Wu ..... 439/607

6,203,373 B1 * 3/2001 Lin ..... 439/607

* cited by examiner

*Primary Examiner*—Brian Sircus
*Assistant Examiner*—Phoung K T Dinh
(74) *Attorney, Agent, or Firm*—Wei Te Chung

(57) ABSTRACT

A universal series bus (USB) connector (1) includes an insulative housing (12), a number of contacts (14) received in the housing and a metal shell (15) enclosing the housing and the contacts in the metal shell. The metal shell includes a front shield (16) and a rear shield (18) engaging with each other. The rear shield has a pair of board locks (184) at opposite sides thereof, which downwardly extend beyond a rear bottom surface (125) of the housing for mounting to a printed circuit board (PCB) (2). The front shield has a rear edge (163) confronting the rear shield. The front shield includes a pair of back plates (167) rearwardly extending from the rear edge thereof and sandwiching the rear shield therebetween. The front shield further includes two supporting devices (168) outwardly extending from the rear edge thereof and locating at opposite sides thereof. The two supporting devices each are inverted L-shaped and have a pin portion (1684) mountable to the PCB.

12 Claims, 5 Drawing Sheets

ELECTRICAL CONNECTOR WITH IMPROVED SUPPORTING DEVICES

BACKGROUND OF THE INVENTION

1. Field of the Invention

The present invention relates to a connector mountable on a printed circuit board (PCB) and having a low profile over the PCB, and particularly to a connector having improved supporting devices for supporting a mating portion of the connector.

2. Description of the related art

U.S. Pat. No. 5,779,489 discloses a universal series bus (USB) connector which is mounted onto a printed circuit board (PCB). However, this connector is relatively large in size, so, when mounted onto the PCB, it occupies a large space of the PCB and has a high profile over the PCB. This design does not follow "light, thin, short and small" trends of a computer. Under this condition, an improved USB connector and an improved PCB are developed. The improved PCB defines a cutout at an edge thereof and the improved connector sinks a predetermined distance into the cutout to obtain a lower profile over the PCB.

Low profile as it is, the improved connector nevertheless has its disadvantages. For example, the improved connector only provides locking means at the portion mounting on the PCB, but does not provide any supporting means at a mating portion of the connector to prevent the mating portion from inclining about the locking means. Hence, an improved electrical connector is required to overcome the disadvantages of the related art.

SUMMARY OF THE INVENTION

A first object of the present invention is to provide an electrical connector securely and reliably mountable on a printed circuit board.

A second object of the present invention is to provide an electronic apparatus including an electrical connector and a printed circuit board, the connector being mounted on the printed circuit board by sinking a predetermined distance to obtain a low profile.

To obtain the above objects, a universal series bus (USB) connector of the present invention comprises an insulative housing, a plurality of contacts received in the housing and a metal shell enclosing the housing and the contacts therein. The metal shell includes a front shield and a rear shield engaging with each other. The rear shield has a pair of board locks at opposite sides thereof, which downwardly extend beyond a rear bottom surface of the housing for mounting to the PCB. The front shield has a rear edge confronting the rear shield. The front shield includes a pair of back plates rearwardly extending from the rear edge thereof and sandwiching the rear shield therebetween. The front shield further includes two supporting devices outwardly extending from the rear edge thereof and located at opposite sides thereof. Each supporting device is inverted L-shaped and has a pin portion mountable to the PCB.

Other objects, advantages and novel features of the invention will become more apparent from the following detailed description of the present embodiment when taken in conjunction with the accompanying drawings.

DESCRIPTION OF THE PREFERRED EMBODIMENT

Figure 1:
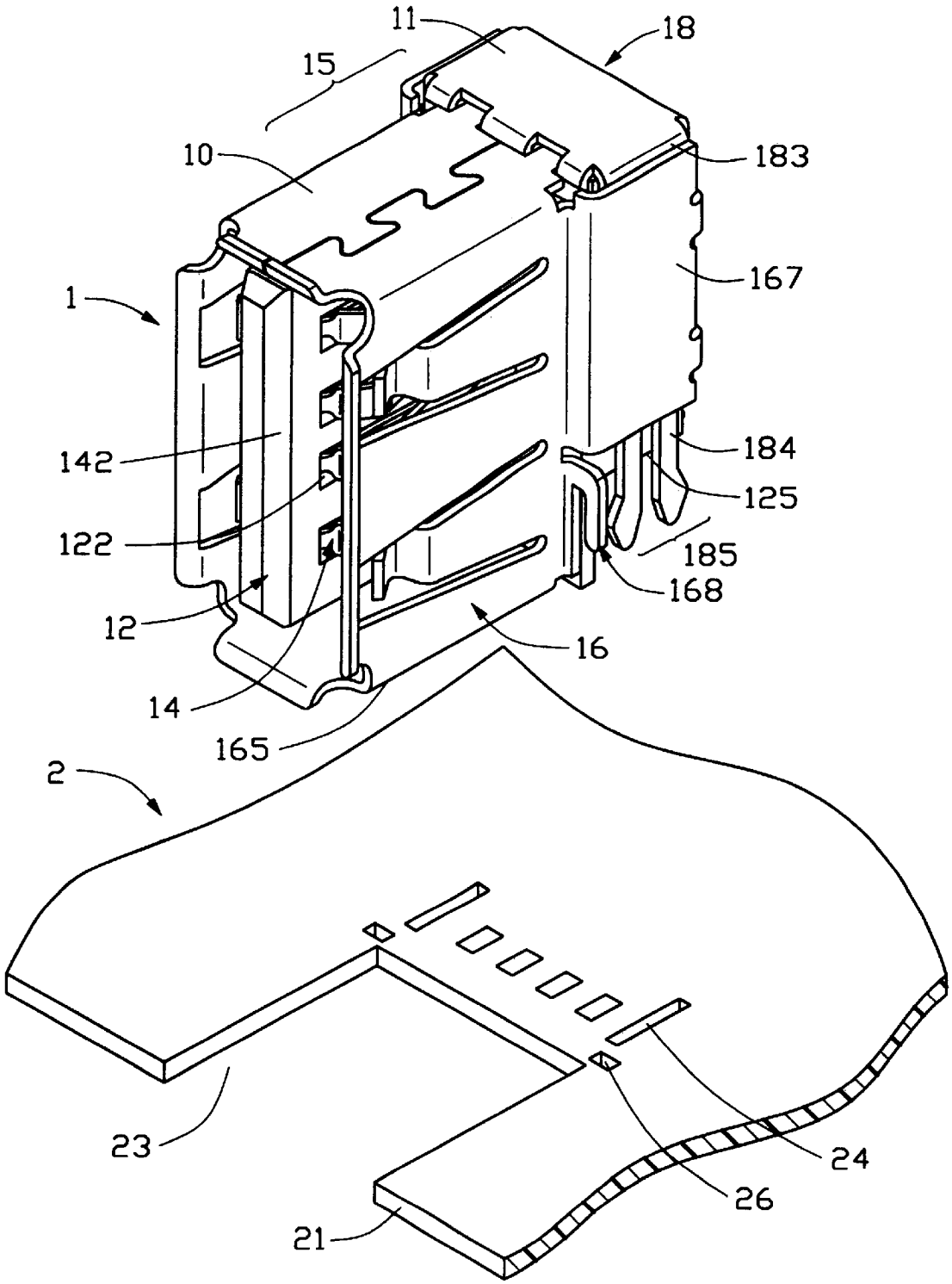
FIG. 1 is a perspective view of an electrical connector and a printed circuit board (PCB) in accordance with a first embodiment of the present invention, wherein the connector is not mounted on the PCB.

Referring to FIG. 1, an electrical connector 1 in accordance with a first embodiment of the present invention is illustrated. The connector 1 is mountable onto a printed circuit board (PCB) 2 by sinking a predetermined distance with respect to the PCB 2 to obtain a low profile over the PCB 2. The connector 1 has a mating portion 10 defaming an engaging port 142 for mating with a mating connector (not shown) and a mounting portion 11 in back of the mating portion 10. The mounting portion 11 is mountable on the PCB 2. The connector 1 comprises an insulative housing 12 defaming a plurality of contact receiving cavities 122 and a plurality of contacts 14 received in the cavities 122, and a metal shell 15 enclosing the housing 12 and the contacts 14 therein to protect the signals transmitting through the contacts from Electro-Magnetic Interference (EMI).

Figure 2:
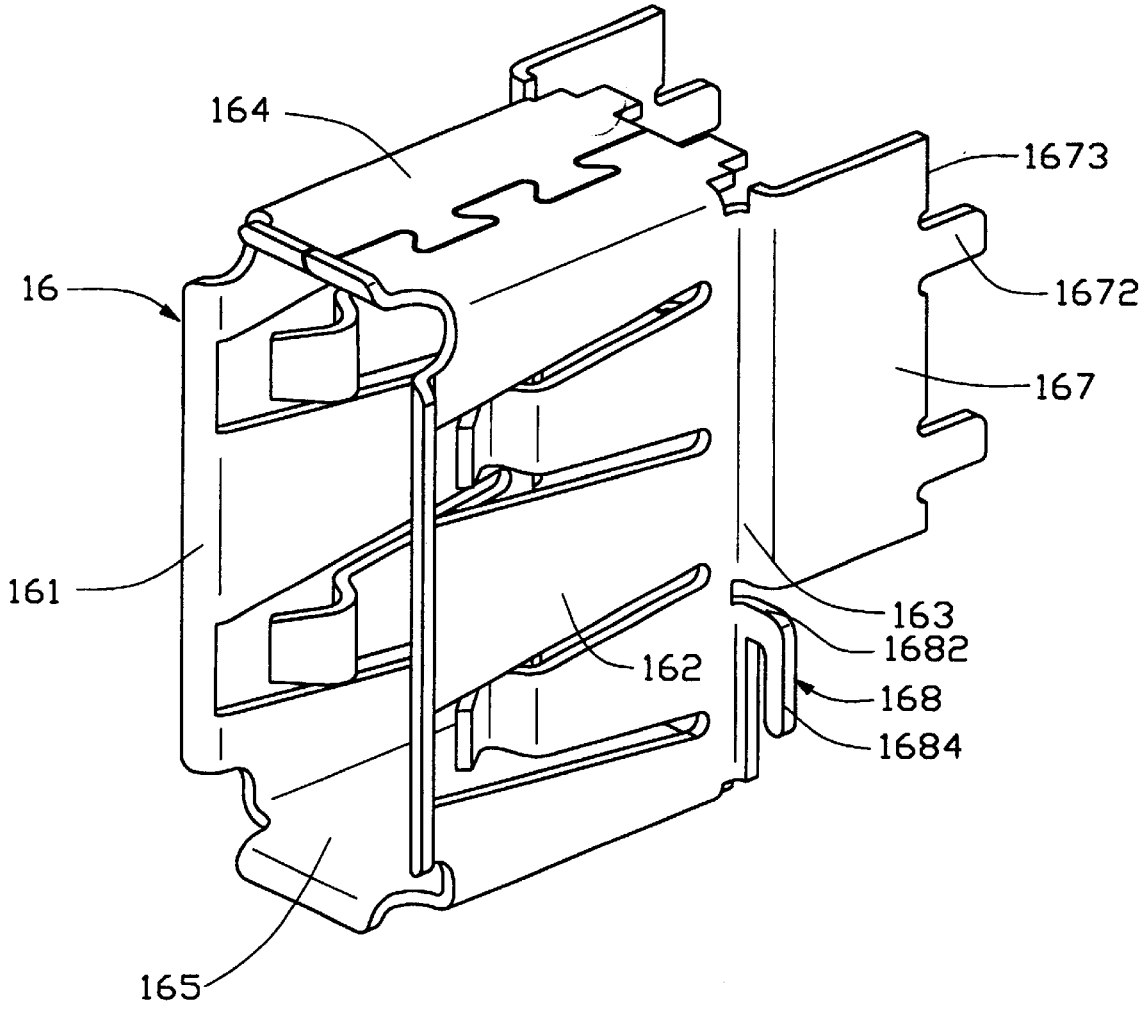
FIG. 2 is a perspective view of a front shield of the electrical connector of FIG. 1.
Figure 3:
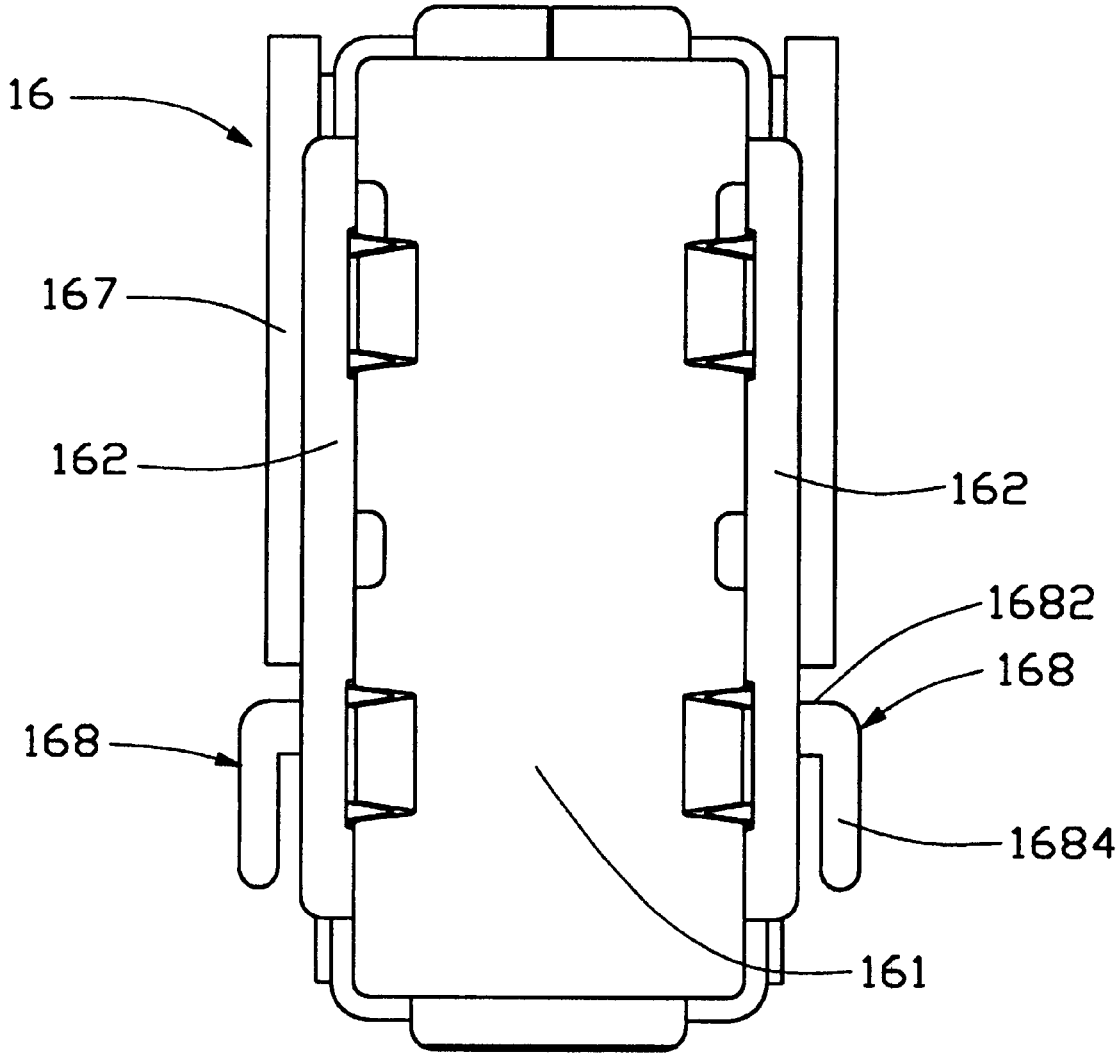
FIG. 3 is a front view of the front shield of FIG. 2.

Referring to FIGS. 2 & 3 in conjunction with FIG. 1, the metal shell 15 includes a front shield 16 and a rear shield 18 engaging with each other. The front shield 16 comprises two side walls 162, a top wall 164 and a front bottom wall 165 and defines a chamber 161 between the side walls 162, the top wall 164 and the front bottom wall 165 for partially receiving the housing 12. The front shield 16 forms a pair of back plates 167 which rearwardly extend from rear edges 163 of the side walls 162. The pair of back plates 167 is parallelly spaced from each other by a distance greater than the distance between the side walls 162. Each back plate 167 forms a pair of tabs 1672 at a rear edge 1673 thereof. The tabs 1672 are engageable with the rear shield 18.

The front shield 16 includes two supporting devices 168 each having a body portion 1682 outwardly extending from the rear edge 163 of a corresponding side wall 162 in a direction generally perpendicular to the corresponding side wall 162. Each supporting device 168 further has a pin portion 1684 extending downwardly from the body portion 1682 for mounting to the PCB 2. In other words, each supporting device 168 is generally inverted L-shaped. Each supporting device 168 is located at a height lower than a corresponding back plate 167 but higher than the front bottom wall 165 of the front shield 16.

Figure 4:
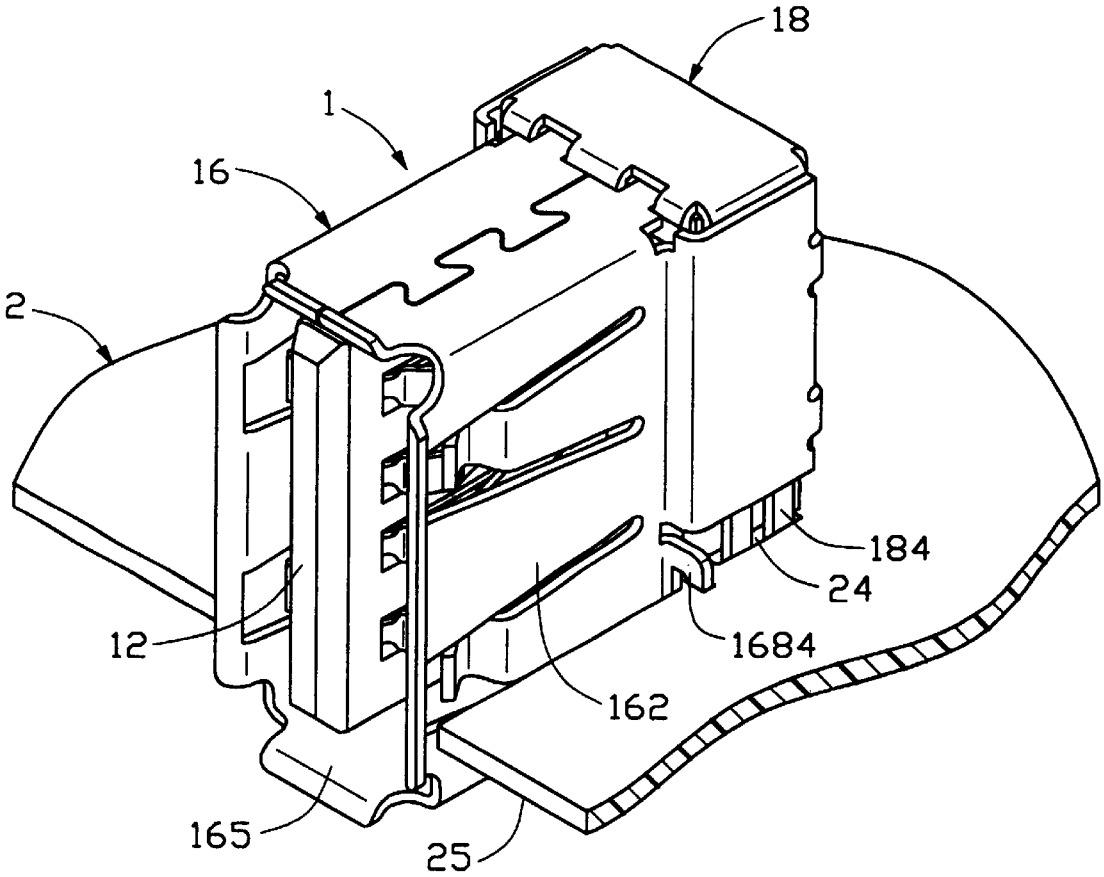
FIG. 4 is a view similar to FIG. 1 but the connector is mounted on the PCB.

Referring to FIGS. 1 and 4, the rear shield 18 comprises a pair of board locks 184 downwardly extending from opposite side walls 183 thereof, respectively. The board locks 184 each have a locking portion 185 engageable with the PCB 2.

In assembly, the front and the rear shields 16, 18 are respectively assembled to the housing 12 from forward and rearward directions. The back plates 167 of the front shield 16 sandwich the rear shield therebetween and the tabs 1672 of the back plates 167 are bent to engage with the rear shield 18. The locking portions 185 of the board locks 184 are generally located at the same height as the pin portions 1684 of the supporting devices 168 are. The locking portions 185 of the board locks 184 and the pin portions 1684 of the supporting devices 168 downwardly extend beyond a rear bottom surface 125 of the housing 12. The supporting devices 168 are nearer to the engaging portion 142 of the connector 1 than the board locks 184.

The PCB 2 defines a cutout 23 at an edge 21 thereof, two first openings 24 and two second openings 26 adjacent to the cutout 23. The first openings 24 and the second openings 26 are located corresponding to the board locks 184 and the supporting devices 168.

After the connector 1 is mounted onto the PCB 1, the locking portions 185 of the board locks 184 and the pin portions 1684 of the supporting devices 168 are inserted into the first openings 24 and the second openings 26, respectively. Solders are applied to the pin portions 1684 of the supporting devices 168 to securely retain the supporting devices 168 to the PCB 2. The rear bottom surface 125 of the housing 12 is positioned on the PCB 2, but the front bottom wall 165 of the front shield 16 extends through the cutout 23 and beyond a bottom face 25 of the PCB 2. In other words, the connector 1 sinks a predetermined distance into the cutout 23 of the PCB 2 to obtain a low profile of the connector 1 over the PCB 2.

Figure 5:
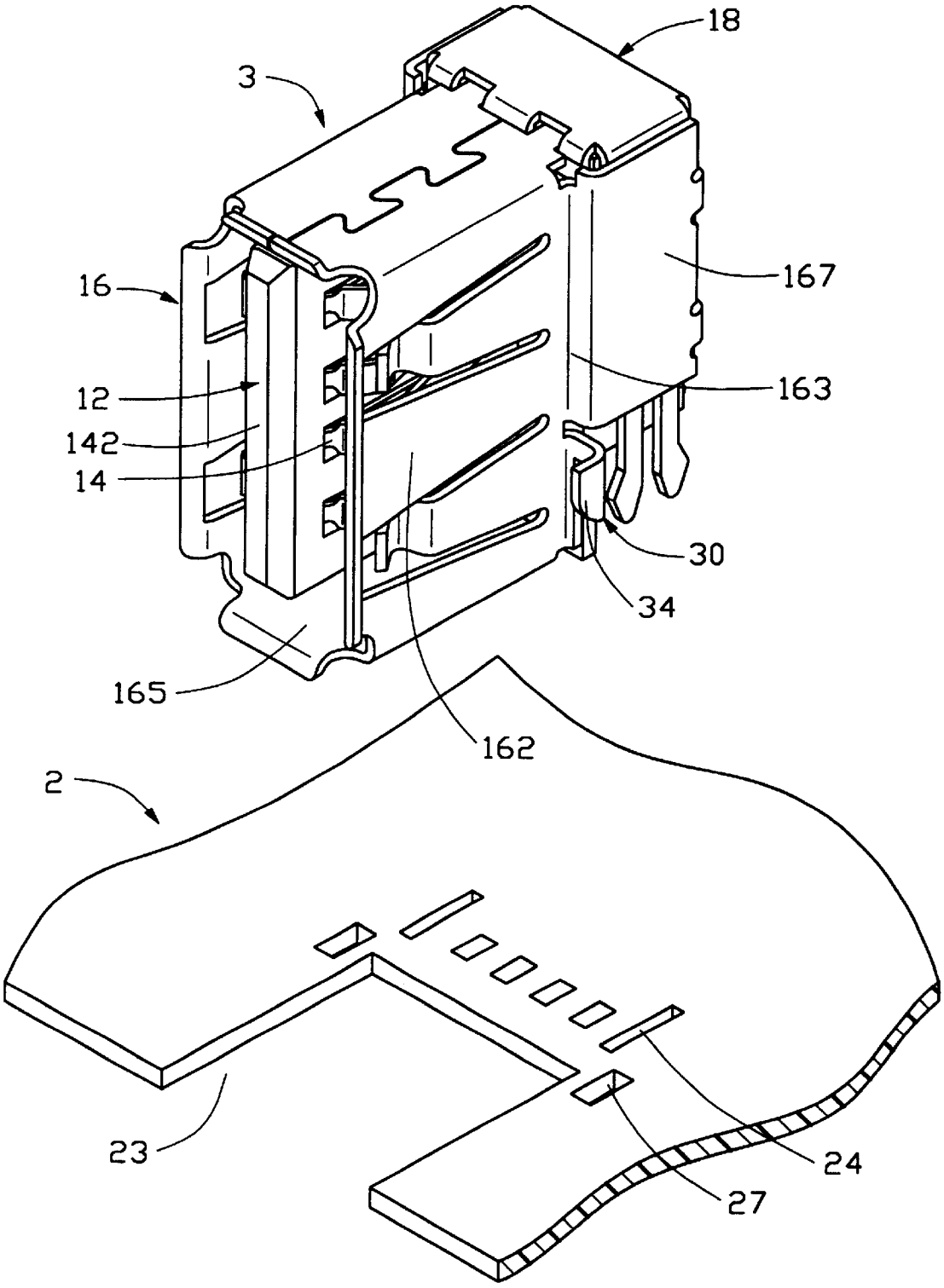
FIG. 5 is a view similar to FIG. 1 but illustrating a second embodiment of the present invention.

Referring to FIG. 5, a second embodiment of the present invention is illustrated. The connector 3 of the second embodiment is generally identical to the connector 1 of the first embodiment except that pin portions 34 of supporting devices 30 of the second embodiment extend toward the engaging port 142 a predetermined distance as well as extend downwardly. Each supporting device 30 is also generally inverted L-shaped. The PCB 2 defines two second openings 27 corresponding to the pin portions 34 of the supporting devices 30.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector having a mating portion and an opposite mounting portion, the mounting portion being mountable onto a printed circuit board (PCB), the mating portion defining an engaging port for engaging with a mating connector in a direction parallel to the PCB, the electrical connector comprising:

an insulative housing defining a plurality of contact receiving cavities;

a plurality of contacts received in the cavities of the housing, respectively;

a front and a rear shields engaging with each other and enclosing the housing therein, the front shield having a rear edge confronting the rear shield, the rear shield providing a pair of board-locks each having a locking portion engageable with the PCB, the front shield having a pair of supporting devices outwardly and downwardly extending from the rear edge of the front shield, each supporting device being inverted L-shaped and having a pin portion mountable to the PCB for supporting the mating portion of the connector, the supporting devices being located closer to the engaging port of the mating portion than the board-locks.

2. The electrical connector as claimed in claim 1, wherein the front shield has a front bottom wall which, after mounted to the PCB, sinks below the PCB, the supporting devices being located at a height higher than the front bottom wall.

3. The electrical connector as claimed in claim 2, wherein the front shield has a pair of back plates each rearwardly extending from the rear edge of the front shield, the back plates engageably sandwiching the rear shield therebetween.

4. The electrical connector as claimed in claim 3, wherein the supporting devices are located below the back plates.

5. An electronic apparatus comprising:

an electrical connector having a mating portion and a mounting portion, the mating portion defining an engaging port for engaging with a mating connector, the mounting portion being mountable onto a printed circuit board (PCB), the electrical connector comprising an insulative housing defining a plurality of contact receiving cavities; a plurality of contacts received in the cavities of the housing; and a metal shell enclosing the housing and the contacts therein, the metal shell having a pair of board-locks and a pair of supporting devices mountable to the PCB, the supporting devices being closer to the engaging port of the electrical connector than the board-locks; and the PCB defining a cutout at an edge thereof, a pair of first openings and a pair of second openings corresponding respectively to the board locks and the supporting devices;

the board-locks and the supporting devices being partially and fixedly received in the first and the second openings of the PCB, respectively, and the mating portion of the electrical connector sinking a predetermined distance through the cutout of the PCB to obtain a low profile of the electrical connector over the PCB; wherein the metal shell comprises a front shield and a rear shield engaging with each other; and wherein the front shield has a pair of rearwardly extending back plates sandwiching the rear shield therebetween.

6. The electronic apparatus as claimed in claim 5, wherein the housing has a rear bottom surface mounted on the PCB and the metal shell has a front bottom wall located at a height below the rear bottom surface of the housing, the front bottom wall of the metal shell sinking through the cutout of the PCB and being located at a height below the PCB.

7. The electronic apparatus as claimed in claim 6, wherein the supporting devices are located at a height higher than the front bottom wall of the metal shell.

8. The electronic apparatus as claimed in claim 5, wherein the front shield has a rear edge confronting the rear shield.

9. The electronic apparatus as claimed in claim 5, wherein the supporting devices each outwardly and downwardly extend from the rear edge of the front shield and are located below the back plates.

10. The electronic apparatus as claimed in claim 6, wherein the supporting devices are located at a height higher than the front bottom wall of the metal shell.

11. The electronic apparatus as claimed in claim 10, wherein each supporting device has a pin portion extending toward both the engaging portion of the connector and the PCB.

12. An electronic apparatus comprising:

an electrical connector housing having a mating portion and a mounting portion;

a plurality of contacts disposed in the connector housing;

a pair of board locks positioned on the mounting portion;

a metal shell enclosing said mating portion and said mounting portion and integrally forming a pair of support devices;

a printed circuit board defining a cutout receiving the mating portion therein, said printed circuit board defining two pairs of openings respectively receiving the pair of board locks and the pair of support devices therein; wherein the pair of support devices are closer to the cutout than the pair of board locks; and wherein each of said pair of board locks defines a first plane extending in a front-to-back direction of the connector housing, and each of said pair of support devices defines a second plane in a lateral direction perpendicular to said front-to-back direction.

* * * * *